US005599010A

United States Patent [19]

Hull et al.

[11] Patent Number: 5,599,010

[45] Date of Patent: Feb. 4, 1997

[54] AUTOMATIC LOADING/UNLOADING OF A DOCUMENT FEEDER FOR A REPRODUCTION APPARATUS

[75] Inventors: Thomas R. Hull, Spencerport; David E. Bettiol, Rush; Theron W. Genaux, Rochester, all of N.Y.

[73] Assignee: Eastman Kodak Company, Rochester, N.Y.

[21] Appl. No.: 363,050

[22] Filed: Dec. 23, 1994

[51] Int. Cl.[6] ..... B65H 5/02

[52] U.S. Cl. ..... 271/3.05; 271/9.09; 271/186; 271/301

[58] Field of Search ..... 271/3.01, 3.04, 271/3.05, 3.14, 4.01, 4.08, 9.09, 186, 301

[56] References Cited

U.S. PATENT DOCUMENTS

| | | | |
|---|---|---|---|
| 4,174,905 | 11/1979 | DiFrancesco et al. | 355/14 R |
| 4,243,316 | 1/1981 | Gustafson | 355/75 |
| 4,469,436 | 9/1984 | Jones et al. | 271/301 X |
| 4,579,326 | 4/1986 | Pinckney et al. | 271/301 X |
| 4,667,951 | 5/1987 | Honjo et al. | 271/3.05 X |
| 4,699,365 | 10/1987 | Smith et al. | 271/3.1 |
| 4,737,820 | 4/1988 | Murray | 271/3.04 X |
| 4,744,553 | 5/1988 | Hirose | 271/3.05 |
| 4,786,039 | 11/1988 | Ito | 271/3.05 X |
| 5,076,560 | 12/1991 | Russel | 271/3.1 |
| 5,078,379 | 1/1992 | Leisner | 271/3.04 |
| 5,152,515 | 10/1992 | Acquaviva | 271/3.01 |

*Primary Examiner*—Karen B. Merritt
*Assistant Examiner*—Scott L. Lowe
*Attorney, Agent, or Firm*—Lawrence P. Kessler

[57] ABSTRACT

An automatic loader/unloader for a document feeder capable of feeding individual sheets of a document sheet set stack from a supply tray to an exposure station of a reproduction apparatus, and return such sheets to such supply tray, in a circulating manner along a travel path. The automatic loader/unloader comprises a first transport for transporting document sheets seriatim into the travel path, and a second transport for transporting document sheets seriatim from the travel path. A diverter selectively diverts document sheets into, or out of, the travel path. The diverter is controlled to load document sheets sequentially in the supply tray by directing document sheets transported by the first transport to form a document sheet set stack in the supply tray, or to sequentially unload document sheets from the supply tray by directing document sheets from the travel path to the second transport.

10 Claims, 4 Drawing Sheets

(PRIOR ART) FIG. 1

AUTOMATIC LOADING/UNLOADING OF A DOCUMENT FEEDER FOR A REPRODUCTION APPARATUS

BACKGROUND OF THE INVENTION

The present invention relates in general to document feeders for reproduction apparatus, and more particularly to a document feeder which is automatically loaded or unloaded with a stack of document sheets to be copied.

Typical commercially available reproduction apparatus are capable of making reproductions at a significant rate (in excess of one hundred copies per minute). Such high reproduction rates are possible, at least in pan, due to document feeders which automatically present document sheets to an exposure station for the reproduction apparatus. Several examples of document feeders enabling high reproduction rates are respectively found in U.S. Pat. No. 4,699,365 (issued Oct. 13, 1987, in the name of Smith et al) and U.S. Pat. No. 5,076,560 (issued Dec. 31, 1991, in the name of Russel).

The exemplary document feeders as shown in the above mentioned U.S. patents, along with most other document feeders, accept a document set stack in a hopper (or some type of receptacle). Individual document sheets are delivered from the stack seriatim to the exposure station or scanner for the reproduction apparatus and then returned in order to the hopper. The desired number of reproductions of the document set stack is made by circulating the individual document sheets one-at-a-time from the hopper to the exposure station, making the desired number of reproductions of each sheet, and then from the exposure station back to the hopper; alternatively, the desired number of reproductions of the document set stack is made by recirculating the individual document sheets from the hopper to the exposure station and then back to the hopper a number of times equal to the desired number of reproductions, with one full reproduction of the document sheet stack being made on each circulation.

While document feeders of the described type have proven to be the most efficient in providing high reproduction rates for reproduction apparatus, one must be able to place the document sheet set stack in the hopper of the document feeder. Ordinarily, this does not present a problem. However, since the document feeders are located on the top of the reproduction apparatus, there are certain physically challenged individuals who cannot reach the hopper to place the document sheet set stack therein. This may be due to the height of the individual or to some disability or impairment. For example, someone confined to a wheel chair may not be able to reach the hopper of the document feeder. This would severely limit the ability of this person to use the reproduction apparatus to the fullest capacity. That is, the reproduction apparatus could only be used in the mode where individual document sheets are manually placed on the exposure station, a process which the document feeder was meant to replace for the increased productivity.

SUMMARY OF THE INVENTION

In view of the foregoing discussion, this invention is directed to an automatic loader/unloader for a document feeder capable of feeding individual sheets of a document sheet set stack from a supply tray to an exposure station of a reproduction apparatus, and return such sheets to such supply tray, in a circulating manner along a travel path. The automatic loader/unloader comprises a first transport for transporting document sheets seriatim into the travel path, and a second transport for transporting document sheets seriatim from the travel path. A diverter selectively diverts document sheets into, or out of, the travel path. The diverter is controlled to load document sheets sequentially in the supply tray by directing document sheets transported by the first transport to form a document sheet set stack in the supply tray, or to sequentially unload document sheets from the supply tray by directing document sheets from the travel path to the second transport.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
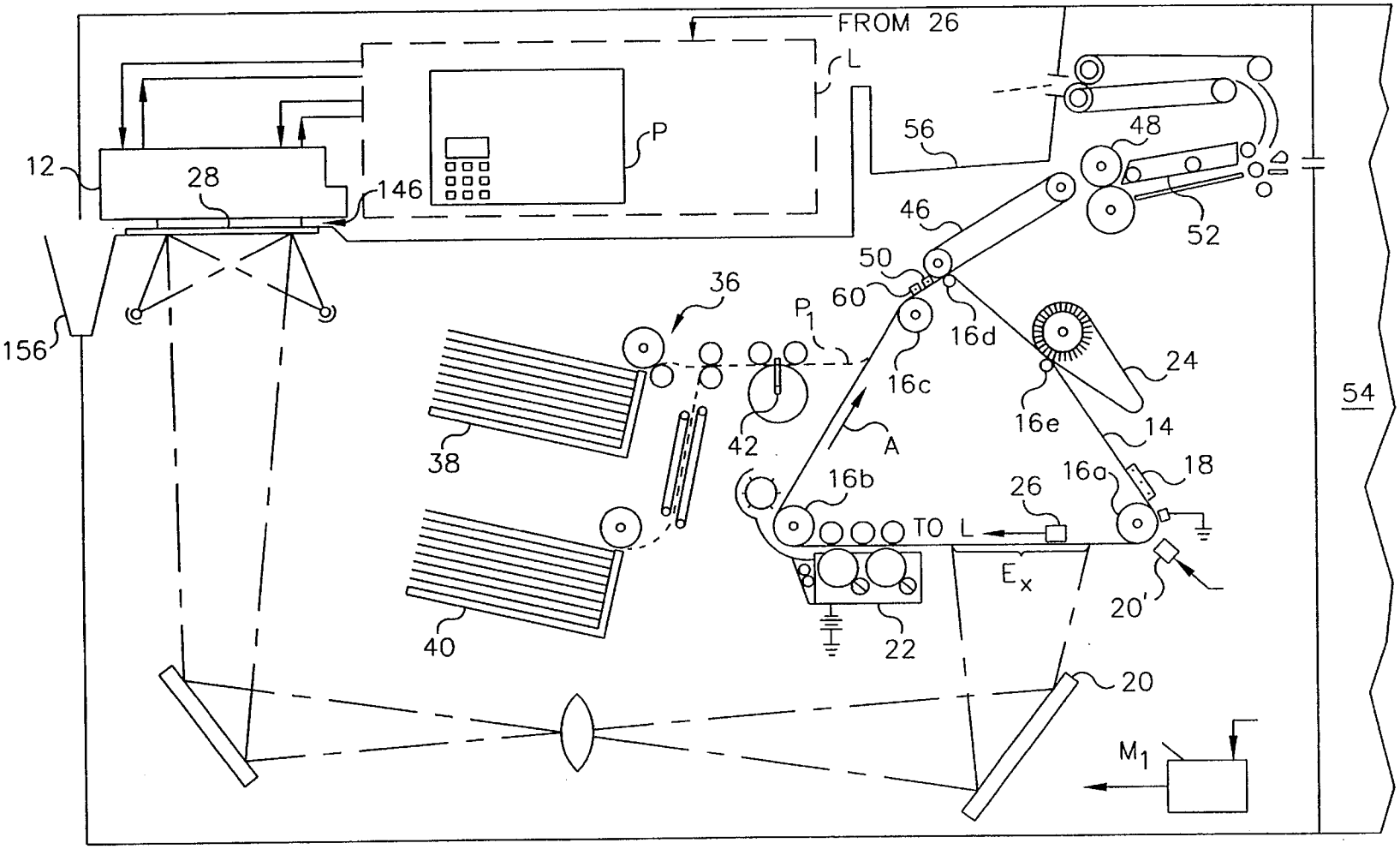
FIG. 1 is a generally schematic illustration of a typical reproduction apparatus employing a document feeder.

Referring now to the accompanying drawings, FIG. 1 shows a reproduction apparatus, designated generally by the numeral 10, with which a document feeder 12 is associated. The reproduction apparatus 10 and the document feeder 12 are exemplary only and any well known feeder or reproduction apparatus, such as a copier/duplicator or printer, in various combinations, are, of course, suitable for use with this invention. They are herein described only to the extent necessary for a full understanding of this invention. For a more complete description of an exemplary reproduction apparatus, see, for example, U.S. Pat. No. 4,174,905, (issued Nov. 20, 1979 in the name of Difrancesco et al); and for a more complete description of an exemplary document feeder, see aforementioned U.S. Pat. No. 4,699,365.

The reproduction apparatus 10 includes an endless web 14 entrained about a plurality of rollers **16*a*–16*e*, the rollers describing a closed loop path for such web. One of the rollers (e.g., 16*a*) is coupled to a motor $M_1$ for transporting the web 14 about the closed loop path, in the direction of arrow A, in operative relation to electrographic process stations, whereby operation of such stations form marking particle developed, transferable images of original information on the web. The web 14 is, for example, a composite construction including a photoconductive layer and a grounded support layer. The electrographic process stations include a charging apparatus 18, an exposure mechanism 20, a developer apparatus 22, a transfer device 60 and a cleaning mechanism 24**.

Under the control of a logic and control unit L, the motor $M_1$ rotates the roller 16*a* to transport the web 14 about its closed loop path into operative relation with the electrographic process stations. The unit L includes, for example, microprocessor receiving operator input signals from the operator control panel P and signals from a timing signal generator 26 detecting the movement of the web 14 about its closed loop path. Based on such signals and a program for the microprocessor, the unit L produces signals to control the transport of the web 14 and the operation of the various electrographic process stations for carrying out the reproduction process. The production of a program for a number of commercially available microprocessors is a conventional skill well understood in the art. The particular details of any such program would, of course, depend on the architecture of the designated microprocessor.

In the operation of the reproduction apparatus 10, the motor $M_1$ rotates the roller 16*a* to move a portion of the photoconductive layer of the web 14 past the charging apparatus 18. The charging apparatus is, for example, a corona charger coupled to a potential source (not shown) which deposits a uniform electrostatic charge on the portion of the web 14. After being charged, such portion moves through a zone $E_x$ relative to exposure mechanism 20. The exposure mechanism 20 provides a reflected light image of information on a document sheet located in juxtaposition with a transparent platen 28 by the feeder 12, in the manner to be explained hereinbelow, to expose the photoconductive layer of the web 14 and alter the uniform charge thereon to form a charge pattern corresponding to such image. Of course, information may also be electronically generated by, for example, an LED array shown schematically in FIG. 1 as element 20'.

After the imagewise charge pattern is formed on the photoconductive layer, the portion of the web 14 bearing such pattern is moved into operative relation with the developer apparatus 22. The developer apparatus 22 which may be, for example, a magnetic brush developer, brings pigmented marking particles into contact with the photoconductive layer. Such particles adhere to the charge pattern on such layer to develop the pattern into a transferable image. A receiver sheet transport mechanism, designated generally by the numeral 36, advances a receiver sheet from a first supply 38 or second supply 40 along the path $P_1$ into contact with the web 14. A registration mechanism 42 times the arrival of the receiver sheet with the movement of the transferable image on the web so that the two are in register.

The transferable image on the web 14 is transferred from the web to the receiver sheet by an electrostatic field produced, for example, by the transfer mechanism 60, such as a charger coupled to a potential source (not shown). The receiver sheet advances with the web 14 to a transport mechanism 46 which strips the sheet from the web and transports the sheet to a fusing mechanism 48 where the transferred image is fixed to the sheet by heat and/or pressure, for example. Stripping of the receiver sheet from the web 14 is aided by a detack charger 50 coupled to a potential source (not shown), for example. After the image is fixed to the receiver sheet, the sheet is transported by mechanism 52 to an output device 54, such as a finisher or binder, for example, or to a hopper 56 for operator retrieval. Substantially simultaneously, the portion of the web 14 previously bearing the transferable images moves past the cleaning mechanism 24, where any residual marking particles on the web are removed. Such portion of the web is then returned toward the charging apparatus 18 to be readied for repeat of the reproduction process.

Figure 2:
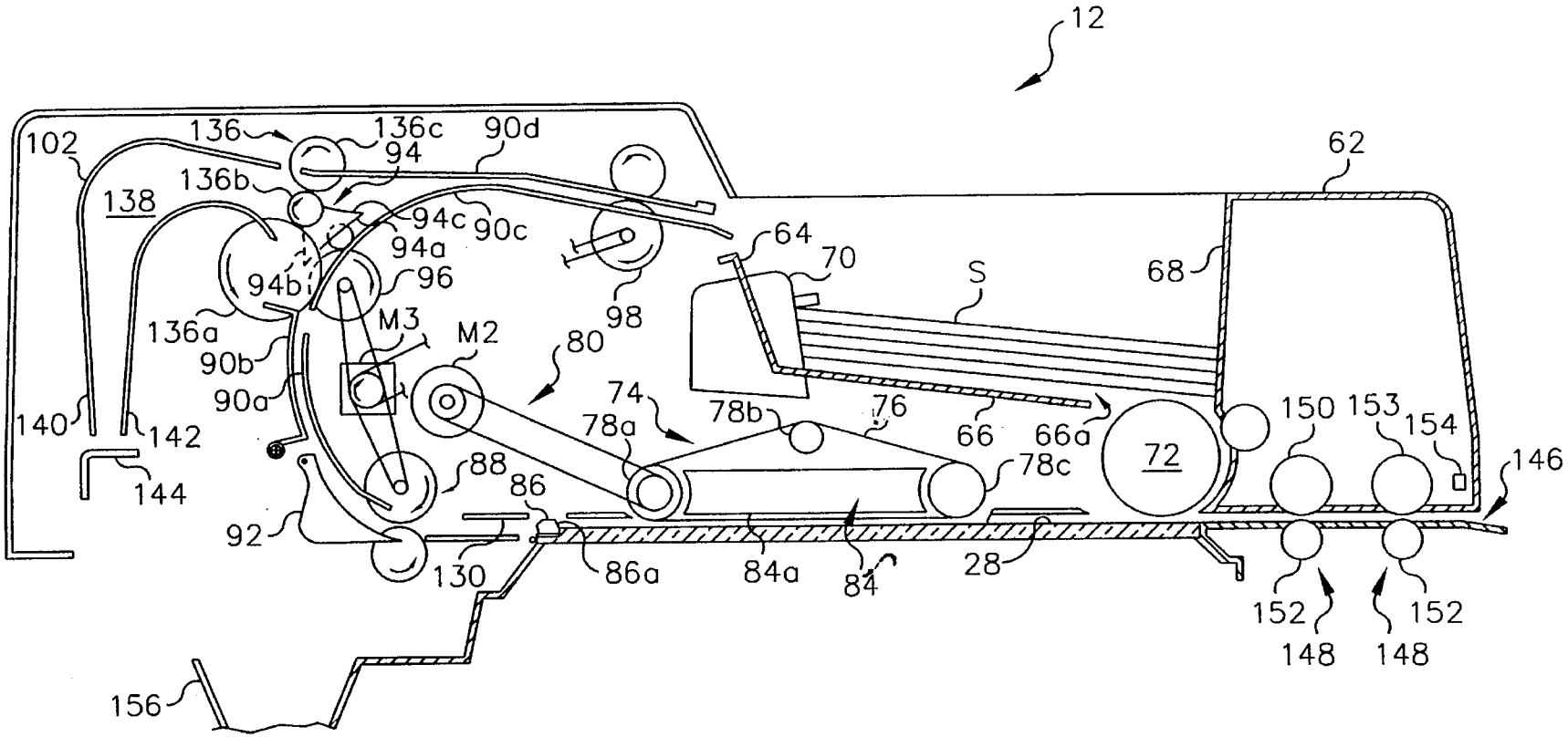
FIG. 2 is a front elevational view, partly in cross-section, of a typical document feeder utilizing the automatic loading/unloading feature according to this invention.

The exemplary document feeder 12 is constructed to present, seriatim, document sheets in juxtaposition with the transparent platen 28 of the reproduction apparatus 20 so that reproductions of the information respectively contained on such sheets may be made. As shown in FIG. 2, the feeder 12 includes a housing 62 within which a supply hopper 64 is located for supporting a set stack of document sheets S. The hopper 64 comprises a readily accessible supply tray 66 angled slightly downward from the horizontal toward a striker plate 68. Document sheets on the supply tray 66 are urged under the influence of gravity against the striker plate 68 for alignment of the forward edges of such sheets. A jogger and set-completed detector 70 are located at the opposite end of the supply tray 66.

A sheet feeding device, such as an oscillating vacuum feeder 72, for example, is located in juxtaposition with an opening 66*a* in the supply tray 66. The feeder 72 selectively vacuum tacks the bottom-most sheet in the set stack S to the peripheral surface thereof and removes such sheet from the set by rotating in a clockwise direction to advance such sheet to a transport mechanism 74. The mechanism 74 comprises a ported belt 76 entrained about rollers 78*a*–78*c*, the rollers describing a closed loop travel path for such belt. The roller 78*a* is coupled by a belt-and-pulley mechanism 80 to a motor $M_2$ to selectively drive the belt 76 about its closed loop path. A vacuum plenum 84 is located within the closed loop path of the belt 76 and has a ported bottom plate 84*a* whereby vacuum from the plenum is effective through the ported plate and the ported belt 76 to tack a sheet to the belt for movement therewith relative to the platen 28 (i.e., from fight to left in FIG. 2).

During the exposure to obtain the reflected light image of the information contained on the transported document sheet, such document sheet is stopped over the platen 28. To insure that the document sheet is in proper register so that the reflected light image is directed to the appropriate area of the photoconductor web 14, a registration gate 86 is provided adjacent to one edge of the platen 28. The gate 86, which is mounted in the apparatus 10, is movable to a first position intercepting the travel path of a document sheet advanced across the platen, or to a second elevated position (not shown) out of such travel path to enable the sheet to pass underneath the gate. (For a more complete description of the registration gate and the mechanism for moving the gate to its first or second position, see U.S. Pat. No. 4,243,316, issued Jan. 6, 1981, in the name of Gustarson.) When the gate 86 is in its first position, the surface 86*a* of the gate provides an edge against which a document sheet advanced by the transport mechanism 74 is stopped at a registered location on the platen; and when the gate is in its second position, the mechanism 74 advances the sheet under the gate to a set of nip rollers 88.

The nip rollers 88 are driven in the indicated direction, through a belt-and-pulley mechanism, by the motor $M_3$. The nip rollers 88 advance the document sheet from the platen into a path described by guides 90*a*–90*d* and diverters 92, 94 (located in their respective positions shown in FIG. 2). Additional nip roller sets 96 and 98, also driven, for example, by motor $M_3$, advance the sheet along such path to return the sheet to the hopper 64. On return to the hopper, the document sheet is received on the top of the set in the same facial orientation as its initial facial orientation in the set.

Figure 4:
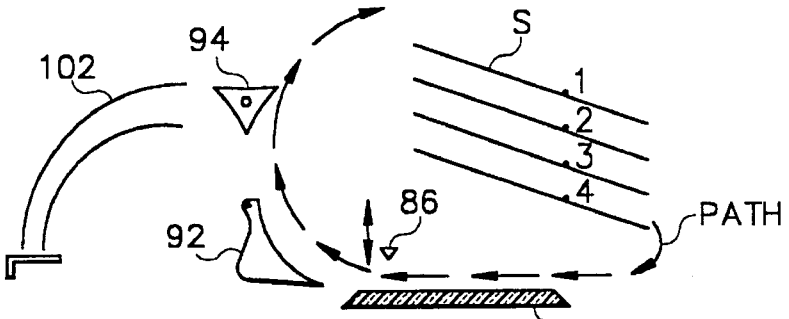
FIGS. 4–7 are respective diagrammatic illustrations of the operation of the document feeder of FIG. 2 showing the automatic loading/unloading feature according to this invention.

The document sheet set stack S is initially located on the supply tray 66 in the hopper 64 with the respective information-containing faces of each sheet being oriented face up (best shown in FIG. 4). Ideally, the set stack is in page sequential order with the first page on top. In this manner, when the reproduction apparatus operation is commenced, the document sheets are advanced seriatim from the hopper 64, last page first, along the travel path Pa across the platen 28 and returned to the hopper. In the travel path, respective information-containing faces of the document sheets are directed toward the platen 28, exposed at the platen, and returned to the hopper in the same facial orientation as when initially located in the hopper. Reproductions of the set stack would be stacked, for example, in the output device 54 or the hopper 56, collated in the same page sequential order as the set stack.

In order to make reproductions of information contained on both faces of respective document sheets in a set stack (e.g., duplex document sheets), a turn-over device 102 is provided (see FIG. 2). The turn-over device 102 comprises a three-roller cluster 136. The middle roller 136*b* of the cluster 136 is coaxially located on the pivot axis of the diverter 94. The turn-over device 102 also includes a sheet receiving chamber 138 formed by guide plates 140, 142 and a resilient stop member 144. To employ the device 102 for turning over a document sheet, the diverter 94 is moved from its position where its surface 94*a* defines the document sheet travel path for returning a sheet directly to the hopper 64 to a position where surface 94*b* intercepts the document sheet travel path. With the rollers of the cluster 136 rotating in the directions as indicated (in FIG. 2), the document sheet is directed by the surface 94*b* of the diverter 94 into the nip between rollers 136*a* and 136*b* and advanced into the chamber 138. The plates 140, 142 guide the sheet in a direction toward the resilient stop member 144. When the lead edge of the document sheet strikes the stop member, it rebounds, thereby reversing its direction of travel so that the lead edge becomes the trail edge. Due to the shape of the chamber 138 and the beam strength of the document sheet, the new lead edge of the moving document sheet is directed to enter the nip between rollers 136*b* and 136*c* to advance the sheet over surface 94*c* of the diverter 94. Thus, the document sheet is returned to the travel path defined by guides 90*c*, 90*d* in a turned over (inverted) condition for delivery to the hopper 64 with the facial orientation thereof being opposite to its initial facial orientation.

The document feeder 12 also has an integral feature for facilitating the making of a reproduction of an individual document sheet which is otherwise not readily handled in a recirculating manner. As shown in FIG. 2, when the feeder 12 is in operative relation with the reproduction apparatus 10, an entrance throat 146 for individual document sheets is provided to the right of the platen 28. A transport mechanism 148 for such individual document sheets is located between the throat 146 and the platen. The mechanism 148 comprises, for example, a pair of feed rollers 150 supported in the feeder 12 and selectively driven in a clockwise direction. The rollers 150 respectively cooperate with nip rollers 152 supported in the reproduction apparatus 10 to advance a sheet inserted in the throat 146 toward the platen 28. A sensor 154 detects the insertion of an individual document sheet into the throat 146 and actuates the transport 148 to advance such sheet toward the platen.

When it is desired to reproduce information contained on an individual document sheet, such sheet is inserted in the throat 146 with the information, containing face directed downwardly. The transport mechanism 148 then advances such sheet to the transport mechanism 74. The mechanism 74 is driven so that the belt 76 moves about its closed loop path in a direction to advance such sheet across the platen 28 into registered engagement with the gate 86 positioned in its registration location. The information contained on such sheet, thus, is directed toward the platen 28 and is exposed to produce a reflected light image to enable a reproduction of the information to be made. Thereafter, the gate 86 is elevated and the transport mechanism 74 advances such sheet under the gate into the nip rollers 88. The diverter 92 is located in a position to intercept the recirculating document sheet travel path and direct such sheet out of the left side of the feeder 12 into a catch tray 156. The catch tray 156 is located on the side of the reproduction apparatus 10 (see FIG. 1) so as to be readily accessible by the operator for retrieval of a document sheet.

With the above described exemplary reproduction apparatus 10 and associated document feeder 12, it will be readily appreciated that for certain physically challenged individual operators, it may be difficult to reach the tray 66 of the feeder (or observe proper positioning of the sheet set stack on the tray) through the opening in the top of the housing 62 thereof. On the other hand, it can be seen with reference to FIG. 1, the level of the entrance throat 146 to the document positioner feature of the document feeder 12 provides a much more convenient access to the document feeder. Therefore, according to this invention, an automatic loading/unloading feature is provided for the document feeder 12, utilizing the document positioner feature thereof.

Figure 3:
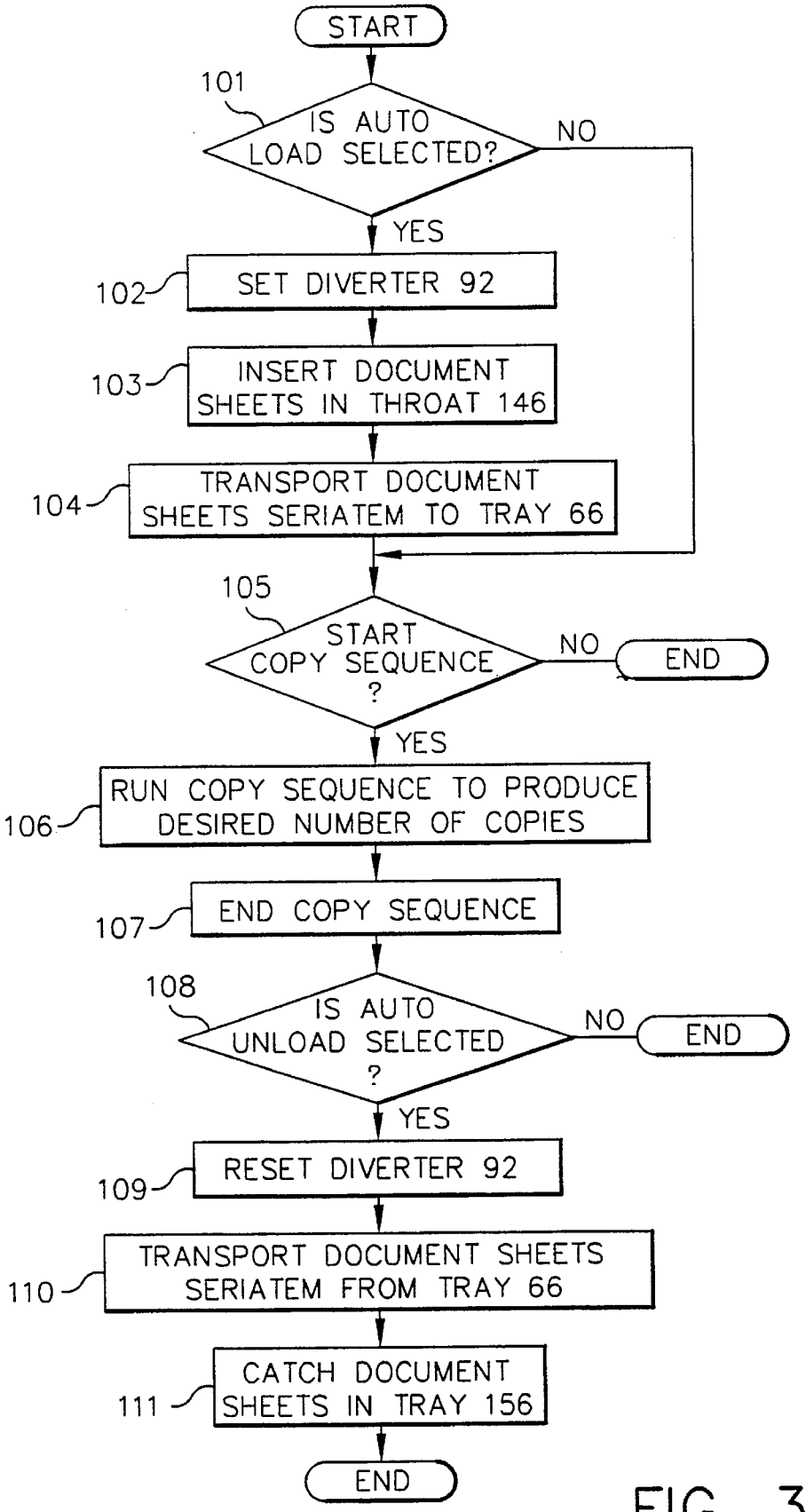
FIG. 3 is a functional block diagram of the utilization of the automatic loading/unloading feature according to this invention.
Figure 5:
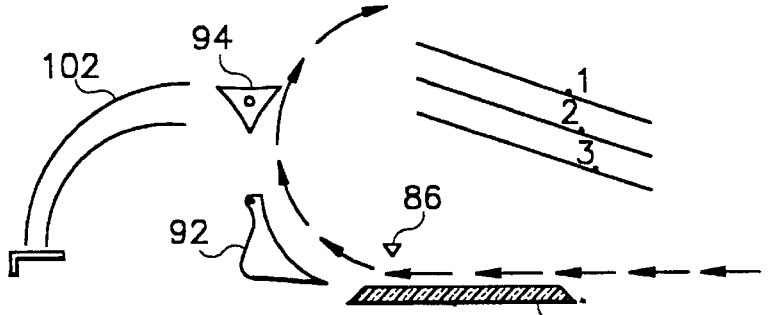

As illustrated in the functional block diagram of FIG. 3, in the automatic loading/unloading of individual document sheets in the document feeder 12, according to this invention, an operator first selects the automatic loading feature (referred to as step 101 in FIG. 3), such as by depressing an appropriate key on the operator control panel P (shown in FIG. 1 ). When the automatic loading feature is selected, the control unit L will set the diverter 92 in the position of FIG. 2 (step 102), forming part of the document sheet recirculation travel path. As depicted in FIG. 5, the operator will then insert document sheets seriatim into the entrance throat 146 of the document positioner feature of the document feeder (step 103).

With the exemplary arrangement, the document sheets are inserted by the operator into the throat 146 of the document feeder 12 last page first, information side down. The positioner transport mechanism 148 will transport the document sheets seriatim into the travel path from the supply tray 66 to the platen 28 immediately upstream of the platen. Due to the appropriate setting of the diverter 92, the document sheets are thereafter transported by the transport mechanisms 74 and 88, 96, and 98, to the supply tray 66 to form a document sheet set stack (such as stack S in FIG. 2) in the supply tray. Once the sheet set stack is fully established in the supply tray, the operator will select the copy operation to start (step 105). The individual sheets of the document stack are then circulated seriatim, in the sequence described above (see FIG. 4), about the travel path between the supply tray 66 and the platen 28 a number of times to enable a desired number of copies thereof to be reproduced (step 106).

Figure 6:
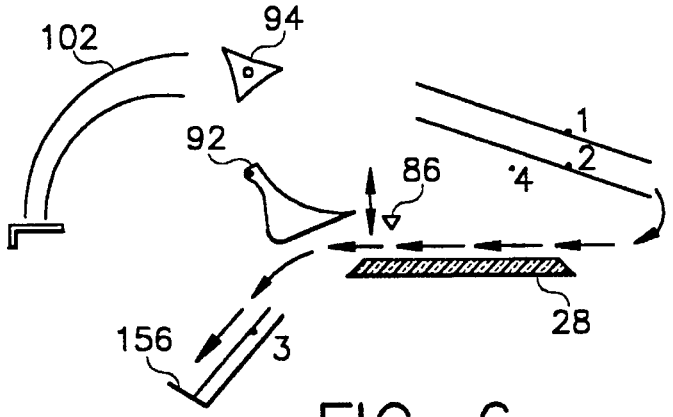

At the end of the copy reproduction sequence (step 107), the operator selects the automatic unloading feature (step 108), such as by depressing an appropriate key on the operator control panel P. When the automatic unloading feature is selected, the control unit L will reset the diverter 92 (step 109) in the position intersecting the document sheet recirculation travel path. Accordingly, as depicted in FIG. 6, the document sheets transported from the supply tray 66 (step 110) seriatim across the platen 28, and thereafter downstream of the platen 28 by the transport mechanism 74, will be directed from the travel path to sequentially unload document sheets into the much more readily accessible catch tray 156 (step 111).

Figure 7:
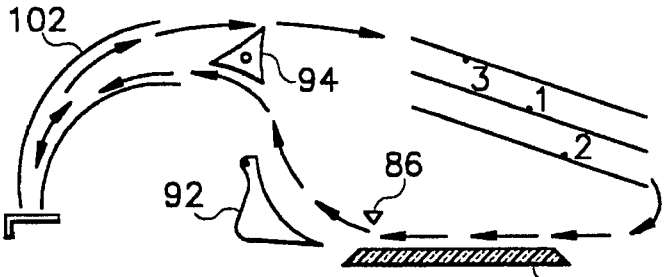

The document sheets delivered to the catch tray 156 in the above manner, would be received in the tray in the reverse collated order. If it is desired to have the document sheets be returned to the operator in the original page sequential order, upon sequentially unloading of the document sheets from the supply tray, the document sheets are circulated an extra time with the sheets being respectively first inverted on this extra circulation (see FIG. 7). Thereafter, the document sheets will be delivered to the catch tray 156 in the same facial orientation and page order as when stacked in the supply tray. It should also be noted that, to improve overall productivity of the reproduction apparatus 10 and document feeder 12 utilizing the automatic loading/unloading feature according to this invention, the control unit L may activate the reproduction apparatus upon the insertion (first) pass of document sheets for loading and/or on the removal (last) pass for document sheets being unloaded to produce a copy set thereof on such pass.

The invention has been described in detail with particular reference to preferred embodiment thereof, but it will be understood that variations and modifications can be effected within the spirit and scope of the invention as set forth in the claims.

What is claimed is:

1. An automatic loader/unloader for a document feeder capable of feeding individual sheets of a document sheet set stack from a supply tray to an exposure station of a reproduction apparatus and return such sheets to such supply tray, in a recirculating manner along a travel path, said automatic loader/unloader comprising:

first transport means for transporting document sheets seriatim along said travel path from said supply tray to said exposure station;

second transport means for transporting document sheets seriatim along said travel path from said exposure station to said supply tray;

diverting means for selectively diverting document sheets into, or out of, said travel path; and control means for locating said diverting means to sequentially load document sheets, prior to recirculation for copying, in said supply tray by directing individual document sheets transported by said first and second transport means to form a document sheet set stack in said supply tray, or to sequentially unload document sheets, after recirculation for copying, from said supply tray by directing individual document sheets from said travel path while being transported by said second transport means.

2. The automatic loader/unloader for a document feeder according to claim 1 wherein said document feeder includes a document sheet inverter and an associated output hopper, and wherein, upon sequential unloading of document sheets, said control means directs document sheets seriatim first to said inverter and thereafter via said second transport means to said output hopper, whereby said document sheets are stacked in said output hopper in the same facial orientation and page order as when stacked in said supply tray.

3. The automatic loader/unloader for a document feeder according to claim 1 wherein said control means sequentially activates said reproduction apparatus to make at least one copy of respective document sheets as said document sheets are transported in said travel path to said exposure station by said first mentioned transport means for loading in said supply tray.

4. The automatic loader/unloader for a document feeder according to claim 1 wherein said control means sequentially activates said reproduction apparatus to make at least one copy of respective document sheets as said document sheets are transported in said travel path at said exposure station prior to transport by said second mentioned transport means for unloading from said supply tray.

5. The automatic loader/unloader for a document feeder according to claim 1 wherein said control means sequentially activates said reproduction apparatus to make at least one copy of respective document sheets as said document sheets are transported in said travel path by said first mentioned transport means for loading in said supply tray, and sequentially activates said reproduction apparatus to make at least one copy of respective document sheets as said document sheets are transported in said travel path prior to transport by said second mentioned transport means for unloading from said supply tray.

6. In a document feeder capable of feeding individual sheets of a document sheet set stack from a supply tray to an exposure station of a reproduction apparatus and return such sheets to such supply tray, in a circulating manner along a travel path, a method of automatic loading/unloading document sheets in said document feeder, said method comprising the steps of:

transporting document sheets seriatim into said travel path;

directing document sheets transported into said travel path to said supply tray to form a document sheet set stack in said supply tray;

circulating the individual sheets of said document stack seriatim about said travel path a number of times to reproduce a desired number of copies thereof; and transporting document sheets seriatim from said travel path to sequentially unload document sheets from said supply tray by directing document sheets out of said travel path.

7. The method of automatic loading/unloading document sheets in said document feeder according to claim 6, wherein in the step of transporting document sheets seriatim from said travel path to sequentially unload document sheets from said supply tray, the document sheets are respectively first inverted and thereafter delivered to an associated output hopper, whereby said document sheets are stacked in said output hopper in the same facial orientation and page order as when stacked in said supply tray.

8. The method of automatic loading/unloading document sheets in said document feeder according to claim 6, wherein in the step of directing document sheets transported into said travel path to said supply tray to form a document sheet set stack in said supply tray, activating said reproduction apparatus to make at least one copy of respective document sheets as said document sheets are transported in said travel path to said exposure station for loading in said supply tray.

9. The method of automatic loading/unloading document sheets in said document feeder according to claim 6, wherein in the step of transporting document sheets seriatim from said travel path to sequentially unload document sheets from said supply tray by directing document sheets out of said travel path, activating said reproduction apparatus to make at least one copy of respective document sheets as said document sheets are transported in said travel path at said exposure station prior to transport for unloading from said supply tray.

10. The method of automatic loading/unloading document sheets in said document feeder according to claim 6, wherein in the step of directing document sheets transported into said travel path to said supply tray to form a document sheet set stack in said supply tray, activating said reproduction apparatus to make at least one copy of respective document sheets as said document sheets are transported in said travel path to said exposure station for loading in said supply tray, and in the step of transporting document sheets seriatim from said travel path to sequentially unload document sheets from said supply tray by directing document sheets out of said travel path, activating said reproduction apparatus to make at least one copy of respective document sheets as said document sheets are transported in said travel path at said exposure station prior to transport for unloading from said supply tray.

* * * * *